US006533675B2

(12) United States Patent
Funk

(10) Patent No.: US 6,533,675 B2
(45) Date of Patent: Mar. 18, 2003

(54) INTERACTIVE METHOD AND APPARATUS FOR TRACKING AND ANALYZING A GOLF SWING

(76) Inventor: Conley Jack Funk, 4581 Brynwood Dr., Naples, FL (US) 34119

( * ) Notice: Subject to any disclaimer, the term of this patent is extended or adjusted under 35 U.S.C. 154(b) by 37 days.

(21) Appl. No.: 09/878,447

(22) Filed: Jun. 11, 2001

(65) Prior Publication Data

US 2002/0187846 A1 Dec. 12, 2002

(51) Int. Cl.[7] ..... A63B 69/36
(52) U.S. Cl. ..... 473/222
(58) Field of Search ..... 473/219, 220, 473/221, 222

(56) References Cited

U.S. PATENT DOCUMENTS 4,713,686 A * 12/1987 Ozaki et al. ..... 358/107
5,111,410 A * 5/1992 Nakayama et al. .... 364/551.01
5,269,519 A * 12/1993 Malone ..... 273/85 G
5,297,796 A * 3/1994 Peterson ..... 273/183.1
5,342,054 A * 8/1994 Chang et al. ..... 273/186.1
5,474,298 A * 12/1995 Lindsay ..... 273/183.1
5,791,351 A * 8/1998 Curchod ..... 128/782
5,797,805 A * 8/1998 Lubell et al. ..... 473/266
5,823,878 A * 10/1998 Welch ..... 463/219
5,826,578 A * 10/1998 Curchod ..... 128/782
5,846,086 A * 12/1998 Bizzi et al. ..... 434/247
6,095,928 A * 8/2000 Goszyk ..... 473/222
6,159,016 A * 12/2000 Lubell et al. ..... 434/247
2002/0064764 A1 * 5/2002 Fishman et al. ..... 434/252
2002/0114493 A1 * 8/2002 Mcnitt ..... 382/107

* cited by examiner

*Primary Examiner*—Thomas N. Moulis

(57) ABSTRACT

The invention pertains to a method of and apparatus for interactively tracking, analyzing and teaching a correct golf swing. A computer with an attached video camera and display monitor is used to superimpose patterns on the monitor over the golfer's live background image that represent the ideal golf swing. Orbit patterns that are calibrated for each individual golfer are displayed as tracks to facilitate club movement that is geometrically correct. Points along the orbits further serve as reference points for analysis of the correct three dimensional shaft direction, club head rotation and body position. A spherical attachment below the club grip focuses the golfer's efforts to move the sphere within the orbits and enhances the computer's ability to uniquely correlate its patterns to the club's position, shaft direction and club face rotation. The computer independently interacts with the golfer using audio and visual means to provide instantaneous prompts and analysis during the swing, assigns a handicap rating and displays the predicted ball flight.

20 Claims, 16 Drawing Sheets

INTERACTIVE METHOD AND APPARATUS FOR TRACKING AND ANALYZING A GOLF SWING

CROSS REFERENCE TO RELATED APPLICATIONS (none)

STATEMENT REGARDING FED SPONSORED R & D (none)

REFERENCE TO MICROFICHE APPENDIX (none)

BACKGROUND AND FIELD OF THE INVENTION

This invention relates to a method and apparatus for tracking, analyzing and teaching correct golf club movements that can instantaneously react to video images of golf swings for the purposes of guiding the club, analyzing the swing and predicting the ball flight.

BACKGROUND AND DESCRIPTION OF PRIOR ART

A golf swing requires the synchronized actions of more than 80 different muscles in a way that is not particularly intuitive or consistent with the human framework. Focusing on the totality of these various muscle movements surpasses the ability of the conscious mind. This requirement for complex and unnatural muscle movements is the principle reason why golf is considered to be a difficult game to master. Even if one is successful in correctly emulating the precise body movements of a given professional, it is unclear that the club movements that are actually produced are correct for a particular person given his or her physical differences.

Correct movement of the golf club is the main objective of a golf swing. If the club moves correctly then learning the associated body movements becomes a far easier goal. There are as many swing styles as there are body sizes and shapes, even among professionals, but the objective of each is to move the club in a very similar way.

Training tools exist that focus on body movements during the golf swing, but none describes or teaches correct club movement in terms of geometric position of the golf club, club head rotation and three dimensional shaft direction at every point of the golf swing. And none performs computer image recognition of the golf club and body position to guide the club movements, analyze the swing and predict the ball flight.

U.S. Pat. No. 6,159,016 compares video recordings of the body motions of a student to that of an instructor or professional. But these recordings lack interactivity because it is only after the student has completed the exercise that he or she can view comparisons. The computers involved receive and display images but do not recognize or analyze club or body movements. That task is left to the student and/or his or her instructor.

U.S. Pat. No. 6,126,449 allows a student to swing a club within a body template image of a chosen professional instructor. The computer receives and displays images but does not recognize the student's actual club or body movements, leaving the entire burden of swing analysis to the student and his or her instructor. Because the golf swing analyzer has no awareness of what the student is actually doing once the template is set in motion, there can be no responsive interaction between the student and the device. No effort is made by the above cited patent to systematically describe correct body position as a function of correct golf club movement. This invention can neither analyze a golfer's swing nor predict his or her ball flight.

U.S. Pat. No. 6,126,449 also requires the student to synchronize his or her activities to the timing provided by the pre-recorded template. The student cannot test or exercise his or her club movements swinging freely back and forth using variable timing.

In the above noted patent there is an uncertain task in deciding which professional's templates to use. Then attempting to emulate the complex body movements executed by that professional can be very difficult and perhaps of no particular advantage in achieving the club and body movements that are correct for the student, given the physical differences between the student and the professional such as differences in anatomy, physiology, flexibility, and strength.

U.S. Pat. No. 6,059,668 teaches the effects of club movement by allowing the student to observe a light that shines in both directions along the club shaft generated by a device attached to the golf club shaft. This method does not help the student to know if the geometric location of the club is correct at any point. This method fails to detect very common problems, such as that of the golfer bending his forward arm during the back swing producing a swing whose arc is too narrow yet able to satisfy criteria indicating that the swing is correct.

With nothing other than a light beam to communicate to the student, the above cited patent lacks the effectiveness and accuracy of image analysis and video presentation. It suffers from not being able to review the analysis of a given swing many times at different speeds. This invention becomes the least effective during the forward swing before impact while the club is making its most rapid movement. During this time the student must interpret the light signals and switch his or her view from the light pointing toward the grip end of the club to that pointing toward the head of the club. This invention is unusable outdoors under bright sunlight and physical adjustments are necessary to the platform that reflects the beam of light when using clubs of different lengths.

U.S. Pat. No. 5,772,449 discloses a method for simulating a golfer's swing by a two step process that first collects data about a golfer's club and body movements and then feeds the data to a commercially available mechanical simulation package. In the second step, an android computer model attempts to reproduce the golfer's swing for the primary purpose of determining what kinds of clubs are best suited to that golfer. This method is not interactive with the golfer and does not teach or include a pattern of an ideal golf swing as is explained below.

Prior inventions have used video recordings of the golf swings of various professional golfers for comparison to a student as though they were magic formulas. In fact, many professionals owe their success more to extensive practice than to excellent techniques. Since golf tournaments can be seen on national television every weekend, most of the techniques that amateur golfers would like to learn have become common knowledge and are practiced by most professionals. What is needed is a systematic and effective way to learn and practice these well-known club and body movements. These techniques can be interactively taught by a software program that is capable of running on most personal computers equipped with an inexpensive video camera such as a USB web cam.

Thus a need exists for an easy to use and inexpensive training system that allows a student to focus precisely on club position and club movement with real-time interactive assistance. When the computer has recognized and analyzed the nature of a particular golf swing problem and its solution, then the presentation to the student is more effective using computer generated graphics and audio methods. Since the computer's recognition software can correlate the club position with the position of the student's body parts, a more focused and systematic approach can be taken by the student to learn to swing correctly. Receiving a quantitative rating based upon the quality of the swing movements and viewing the predicted ball flight makes learning and practicing more enjoyable.

A further need exists for analysis while practicing back and forth swings with no predetermined timing. The student should be able to spontaneously perform a sequence of swings without prior planning or setup. For a proficient and experienced golfer, this capability provides effective audio and video feedback during warm-up exercises.

A still further need exists to effectively analyze the correctness of a golf swing at all points of a golf swing because any incorrect variations can have undesirable consequences. Since normal swing motions occur at a high rate of speed, a student or instructor finds it very difficult to analyze a golf swing in real-time. Previous inventions do not have the benefit of the computer instantaneously recognizing, analyzing, understanding and responding to the motion of the student's golf club. When evaluating the geometric coordinates and angles of a golf club in motion, an experienced professional instructor cannot compete with a computer program that has efficient recognition software.

SUMMARY AND OBJECTS OF THE INVENTION

The present invention provides a golf swing training method and apparatus that measure a student's swing against a semi-circular back swing orbit that is followed by a circular forward swing orbit. The locations within these orbits serve as reference points for the computer to recognize the correct club movements and body positions that comprise the ideal golf swing.

The derivation of these orbits is based upon analysis of a multiple of swings of many professional golfers. The above noted multiple of swings were superimposed over each other in a synchronized slow motion process that revealed a pattern of an ideal swing that is common to substantially all professional golfers. The pattern showed a semi-circular orbit for the golfer's hands during the back swing and a separate circular orbit for the golfer's hands during the forward swing. These orbits were easily extendable to an area of the club shaft near the golfer's hands. The choice of the location of the club shaft near the golfer's hands as a reference point was also valuable to keep the orbits as small as possible so the video camera's recognition capabilities are optimized by having the golfer as close to the camera as possible.

The orbits are automatically determined while the golfer assumes his or her normal stance by considering the height and other physical characteristics of the golfer. They are further verified by several calibrating movements described below. The orbital locations form a basis for evaluating club shaft direction, clubface rotation and overall body position during a golf swing.

A spherical attachment is placed on the shaft below the golf club grip. The sphere is tracked in real time by a software program that receives video camera images, The software program continuously monitors the position of the spherical attachment to determine if the sphere is in a correct orbital location within the swing orbits. Patterns on the spherical attachment are analyzed by the computer recognition software to determine the rotation of the club shaft that corresponds to the position of the clubface at a given orbit location.

Polar direction identifiers located above and below the sphere. These facilitate efficient recognition of the direction of the club shaft at a given orbit location and further verify rotation of the clubface.

A conventional personal computer control interface such as a mouse or keyboard is used to select the analysis activities, options and displays to be used. The student can use a separate monitor for each display or use multiple windows of a monitor capable of displaying combinations of views simultaneously.

Each analysis activity asks the student to assume his or her normal stance position in front of the video camera and then to make body adjustments until the stance is deemed satisfactory by the computer recognition software. If the student has already calibrated his or her orbits, then the back swing and forward swing orbits are superimposed over the real-time image of the student golfer.

One display shows the student's image and swing orbits plus the correct club shaft direction and clubface rotation at various intervals along the orbital path.

Another display shows a blow-up of the region of the spherical attachment to precisely view the student's actual club position at that moment and the relation to the display of the correct club position with respect to orbital location, club shaft direction and club head rotation.

One analysis activity allows the student to swing freely while viewing his or her image in real-time within the display of the orbits with the club position guide shown at the next orbital path checkpoint. Audio and visual responses or prompts are given to his or her movements. This activity allows partial or complete swings and permits the student to swing back and forth as many times as he or she desires. The speed of the swing is not measured. Typically, a student chooses to swing in slow motion until a certain level of success is realized. Optionally, the display can freeze the frame at the occurrence of the first erroneous movement.

Another analysis activity requires that the student perform one complete golf swing that is followed by a detailed analysis of the swing at each sequential orbital location. Body movement errors are identified at each orbital location and illustrated suggestions for corrections are offered. Tempo of the swing is evaluated. A USGA handicap rating is assigned to the swing that was determined statistically by a correlation of golfer's actual handicaps versus their level of correctness of swing. Instant replay of the swing can be done at regular speed or in slow motion.

Another analysis activity predicts the ball flight and distance based upon the real-time analysis of the swing leading to the ball impact position. When this activity is selected, the display switches to an illustrated view of a practice range upon impact and the golfer can see his ball in flight as it travels toward the green. A detailed analysis can be viewed subsequently for the same swing.

An object and advantage is to provide a golf swing analysis and training method that recognizes the club position through the images generated by a video camera to measure and guide club movement at all points of the golf swing. Since a computer program is doing all of the analysis, a professional instructor is not required to be part of the process.

Another object and advantage is to provide a swing analysis and training method that is simple for the student to execute allowing him or her to focus upon guided movements of the club instead of concentrating on coordinating many unnatural body muscle movements simultaneously.

Another object and advantage is to provide a swing analysis and training method that quantifies correct club position by geometric location and uses this location as a basis to determine correct club shaft direction, clubface rotation and body position.

Another object and advantage is to automatically calculate the correct swing orbits for the student based upon his or her physical characteristics and a few calibration movements.

Another object and advantage is to allow the student to customize his or her swing orbits if the standard orbits do not work such as if he or she has physical limitations.

Another object and advantage is to display and measure the precision and correctness of the golf club movements while the student swings freely through orbits superimposed over the live video image of the student using his or her own timing.

Another object and advantage is to display and measure the precision of the golf club position and movement during a golf swing using a zoomed blown-up view of the current orbital focal point showing the orbit outline, the actual club position and the correct club position.

Another object and advantage is to display a computer generated image of the correct body position of the student relative to the current orbital location.

Another object and advantage is to evaluate the timing of a complete golf swing.

Another object and advantage is to quantify a complete golf swing with a USGA handicap rating based upon correctness of the club movement to show progress to the student and to make training fun.

Another object and advantage is to predict ball flight, such as a hook or slice, based on club head rotation before and after impact with the golf ball.

Another object and advantage is to allow the student to perform instant replay of any analyzed swing.

Another object and advantage is to be able to use the golf swing analyzer indoors or outdoors.

Still further objects and advantages will become apparent from a consideration of the ensuing description and drawings.

DETAILED DESCRIPTION OF THE PREFERRED EMBODIMENTS OF THE INVENTION

Figure 1:
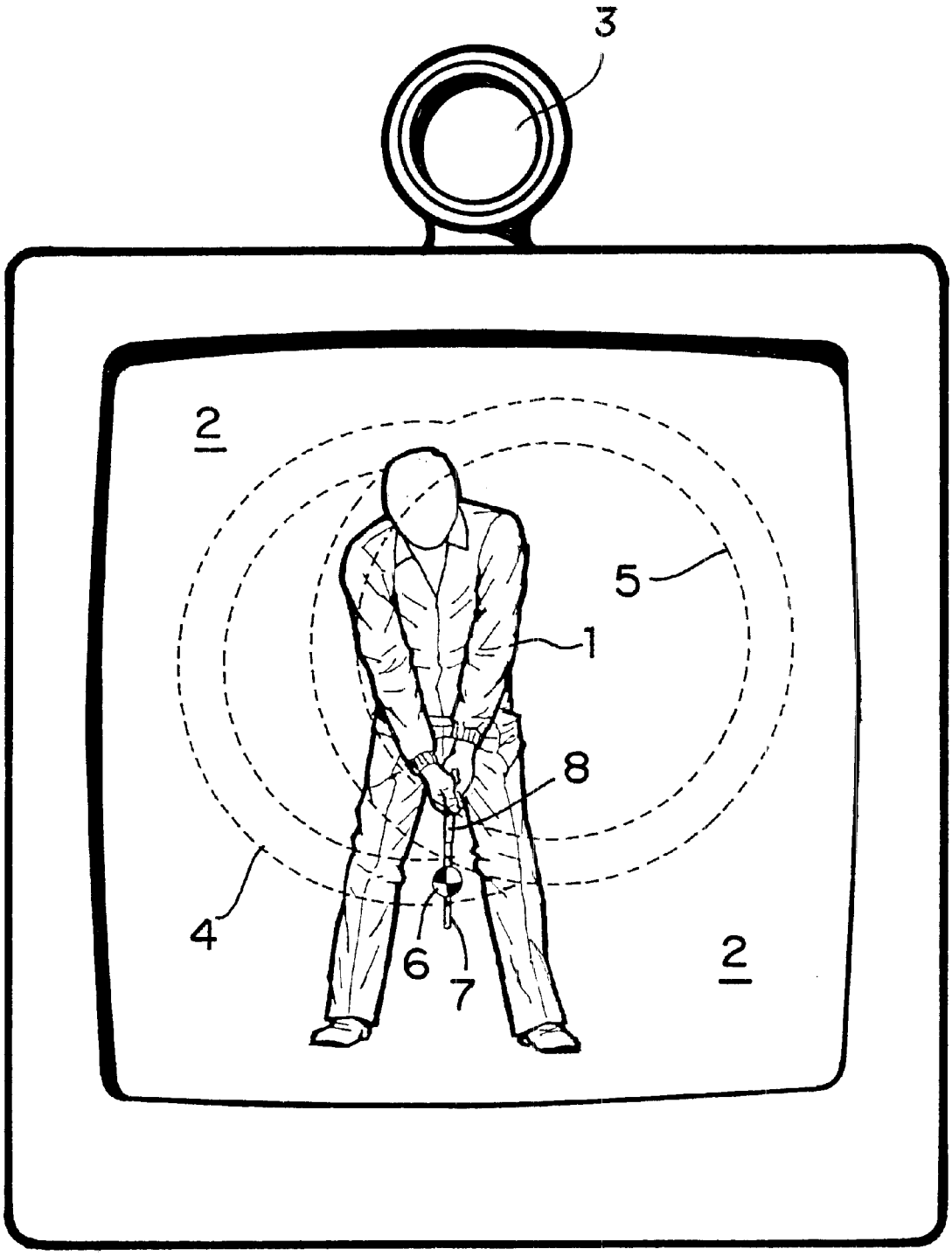
FIG. 1 shows a computer monitor displaying a pattern of an ideal golf swing including the golfer standing in front of the monitor.

FIG. 1 shows a live display of a student golfer who is standing in front of a desktop computer monitor display 2. The student's image as captured by an attached video camera 3 is displayed with his or her ideal swing patterns superimposed as a back swing orbit 4 and a forward swing orbit 5. The golfer is just beginning his or her back swing as indicated by the position of the spherical attachment 6 to his golf club shaft 7 that has been installed just below the grip 8.

Figure 2:
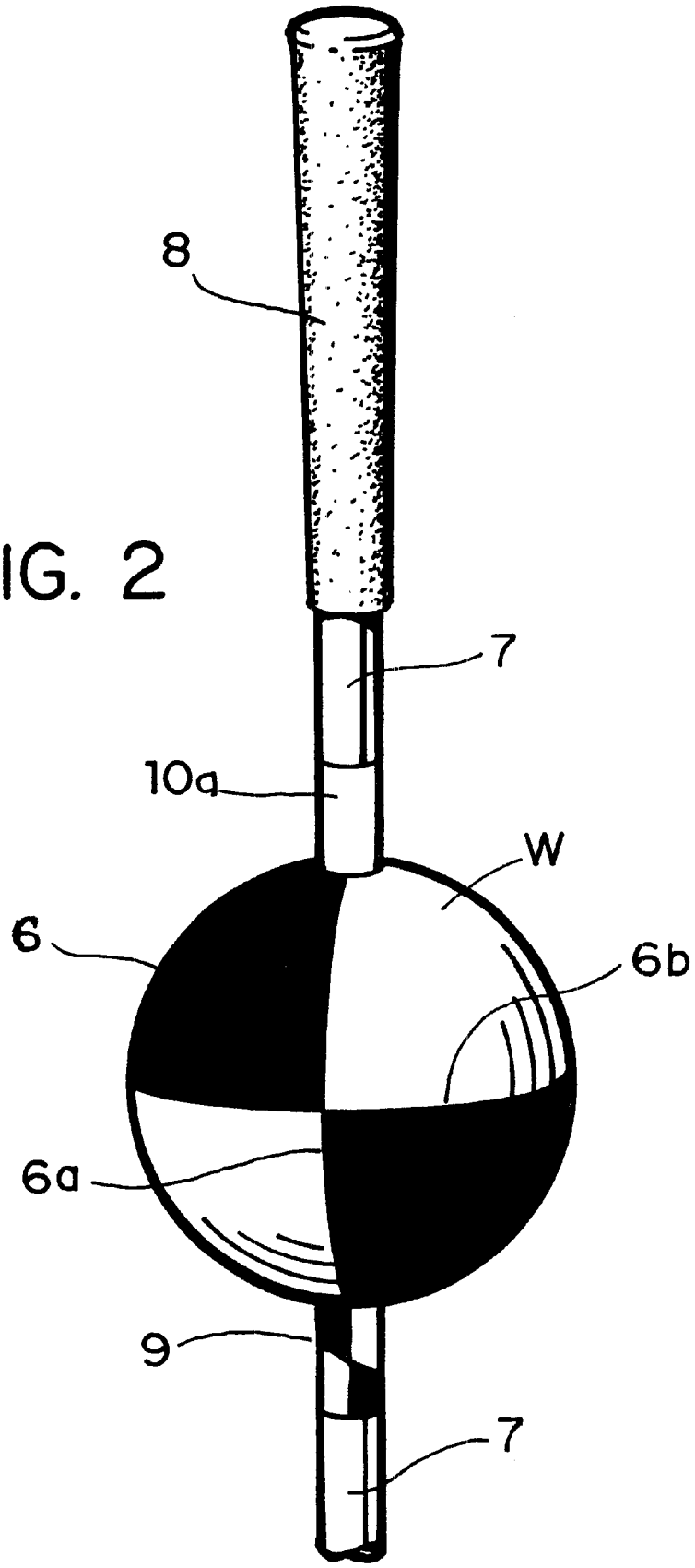
FIG. 2 illustrates part of the golf club shaft having a signal emitting sphere attached thereon including club rotation indicia.

FIG. 2 shows an enlarged view of the spherical attachment 6 that has been installed over the golf club shaft 7. The spherical attachment. 6 is constructed from lightweight and flexible rubber material that can be slid over the grip 8 but that remains in place on the shaft 7. The surface of the sphere 6 is hard and smooth for maximum reflectivity. The size of the sphere 6 is large enough that shapes and patterns allow the computer to uniquely determine the geometric location of the golf club, the direction of the club shaft and the rotation of the shaft with respect to the clubface yet small enough that it does not degrade or complicate the swing experience.

The sphere 6 is divided into four equal sized quadraspheres and the spherical attachment of FIG. 3 is installed so that the vertical alignment mark normally placed on a golf shaft 7 by the manufacturer corresponds to the dividing line between the eastern and western hemispheres. When viewing the frontal stance position as in FIG. 1, this dividing line 6*a* is entirely visible and parts of each of the quadraspheres are visible to the video camera 3. There is also a dividing line 6*b* between the northern and southern hemispheres. These quadraspheres are colored alternating black and white for maximum contrast and best recognition in varying lighting conditions. Bordering the top of the sphere is the grip end polar direction indicator 10*a* that is colored white. The club head-end polar direction indicator 9, colored white and black, has a barber pole effect that further verifies the rotation of the club shaft 7. All of these alternating black and white placements on the sphere 6, below the sphere 6 at 9 or above the sphere 6 at 10*a* are designed to emit a location signal to be picked up by the video camera 3 for further processing in the computer.

The computer can efficiently recognize the video camera's 3 image of the spherical attachment in FIG. 2 for instantaneous analysis as to correct orbit location. The color patterns that the video camera 3 produces for the sphere 6 and the polar direction indicators 9 and 10*a* are unique for any angle of club shaft rotation and for any three-dimensional club shaft direction.

FIGS. 3A to 3K illustrate representative frames, as displayed on a monitor, of the spherical attachment 6 passing through the semicircular back swing orbit 4 and the circular forward swing orbit 5 during a correct swing. The direction of the clubface, that is the club shaft rotation, is determined from the video camera's 3 view of the patterns of the spherical attachment in FIG. 2. The patterns of the sphere 6 and polar direction indicators 9 and 10*a* determine the three dimensional direction of the club shaft.

An imaginary line of infinite length in each direction exists which passes through the ball and the target flag on a golf green. This is referred to as the target line. The approximate two-dimensional space that the club "slices through" during a correct swing is referred to as the swing plane. The angle of the swing plane is most affected by the golfer's normal stance and the length of the golf club he or she is currently using. If the three dimensional direction of the club's shaft 7 as determined by the camera's 3 image of the spherical attachment in FIG. 2 is within the swing plane, the swing is said to be on plane at that moment.

Figure 3A:
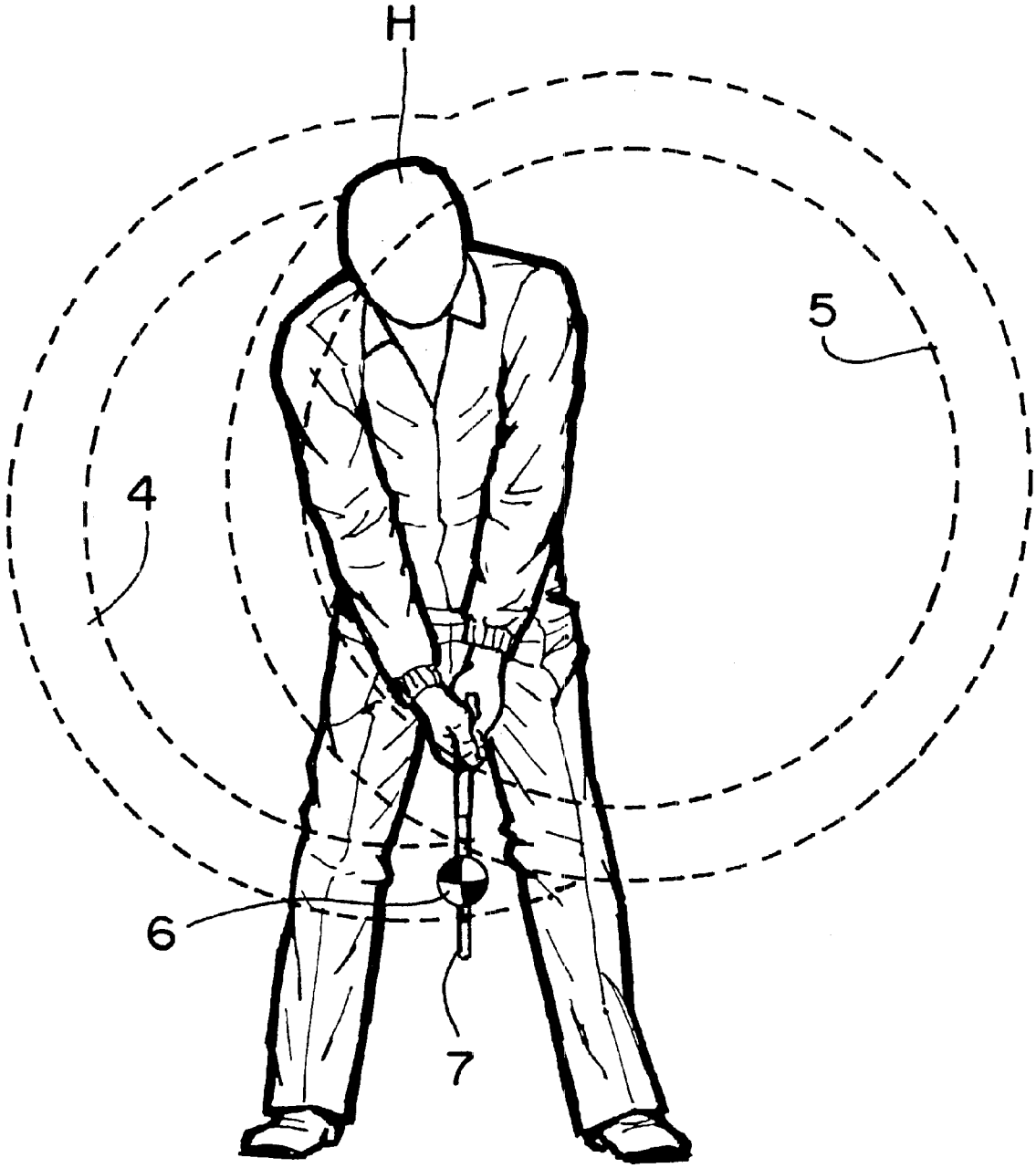
FIGS. 3A–3K illustrate successive locations of a golf club during a swing.

FIG. 3A shows the initial movement of the spherical attachment of the club in the back swing orbit 4. The video camera's 3 view of the sphere 6 verifies to the computer that the sphere 6 is in a correct orbit location. The image of the spherical attachment further determines that the direction of the club shaft 7 is vertical and on plane and correctly rotated so that the clubface is pointed toward the golf ball and the target. The computer verifies that the golfer's head H is positioned correctly behind the golf ball as determined by the club shaft direction.

Figure 3B:
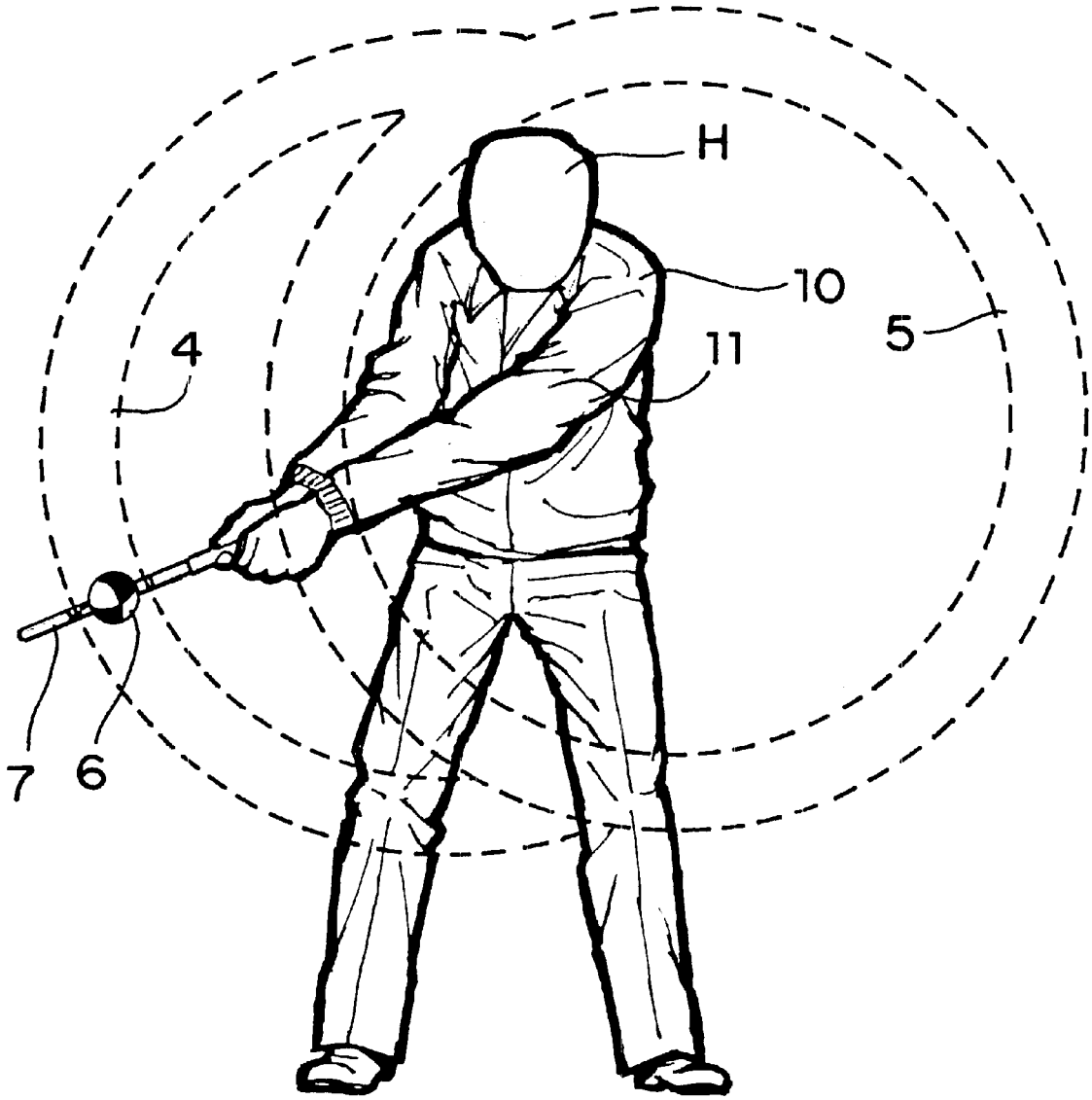

FIG. 3B shows continuation of the sphere 6 in the back swing orbit 4. The left shoulder 10 has begun to turn to the golfer's right while the club shaft 7 direction is essentially that of the straight left arm 11. The patterns of the sphere 6 indicate that the club shaft 7 has correctly rotated so the clubface is visible to the video camera 3. The computer verifies that the golfer's head H has correctly moved to the right with the turn of the left shoulder to a position vertically above the inside the golfer's right foot.

Figure 3C:
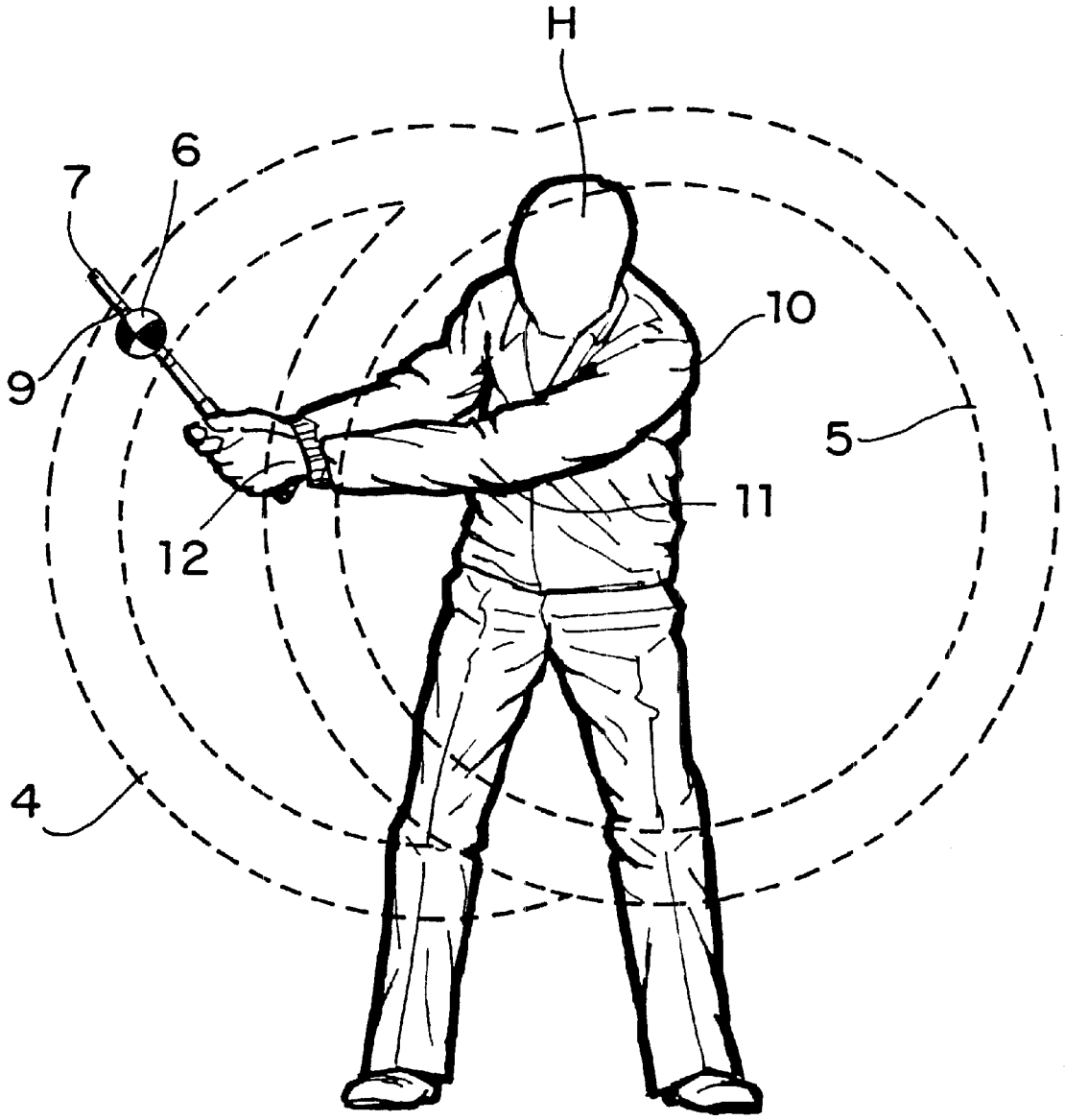
Figure 3D:
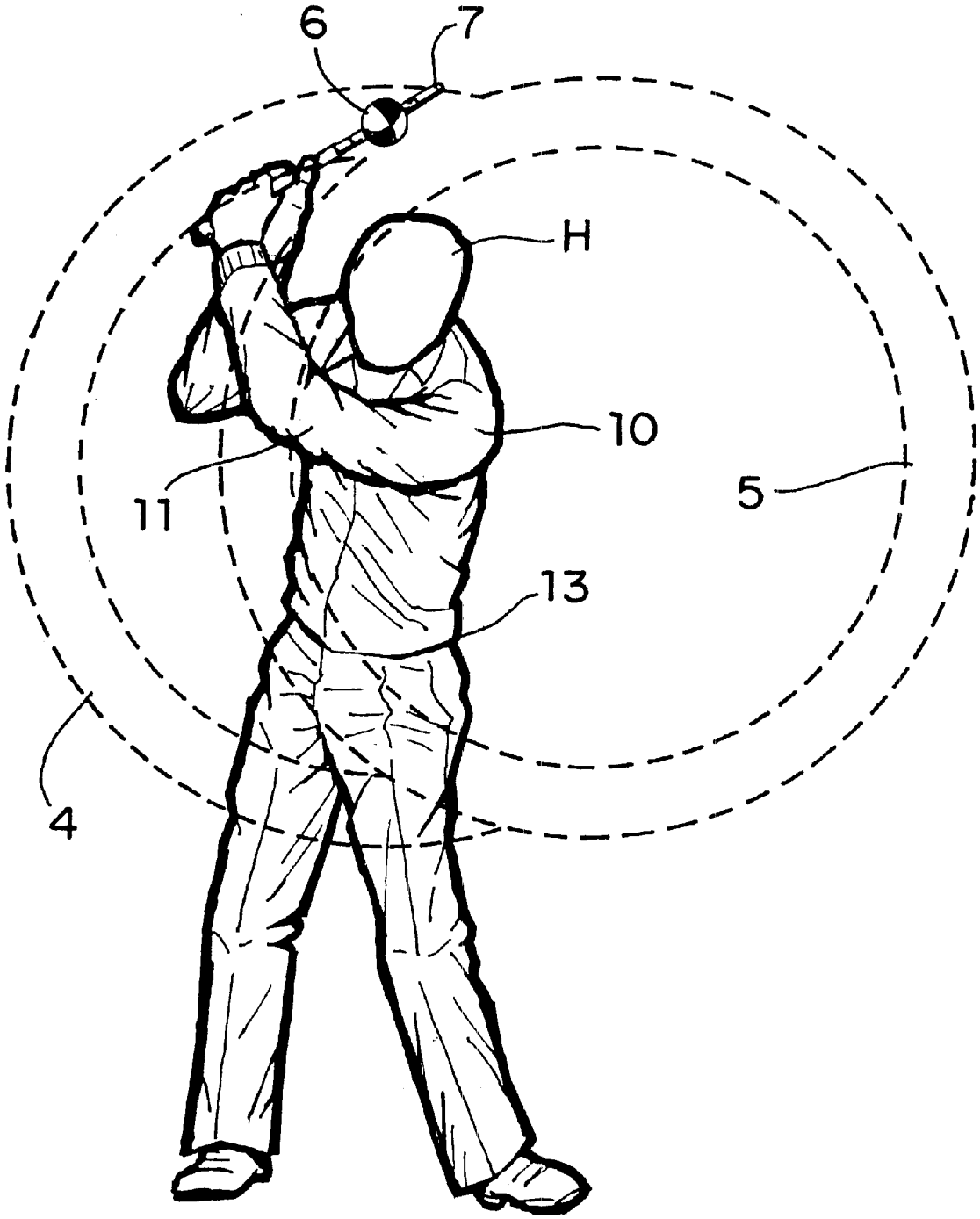

FIG. 3C proceeds along the back swing orbit 4. The left arm 11 is pointing in a direction that is 180 degrees away from the target and parallel to the target line. The wrists 12 are partially cocked so that the club shaft 7 forms an approximate 45 degree angle with the direction of the left arm 11. The patterns of the sphere 6 show that the club shaft is still rotated so that the clubface is pointing toward the camera 3. This pattern along with the polar direction indicators show that the grip end of the club is correctly pointing at the golf ball and that the swing is on plane. The computer verifies that the golfer's head 9 has correctly moved to the right with the continued turn of the left shoulder to a position vertically above the outside edge of the golfer's right foot FIG. 3D shows the near completion of the back swing, with the left arm 11 reasonably straight and the club shaft 7 direction approximately 90 degrees past the direction of the left arm 11. The image of the sphere 6 verifies to the computer that the clubface is correctly rotated toward the camera 3 and that the grip end of the club still points along the target line verifying that the swing is on plane. The computer verifies that the golfer's head H has correctly moved to the right with the continued turn of the left shoulder 10 to a position vertically above the outside edge of the golfer's right foot. A very important observation can be made by the computer's software from the video camera image while the spherical attachment is in this orbital location. Since the edge line of the golfer's left hip 13 is still in the same left-justified location as in the normal stance this verifies that the golfer has correctly rotated his or her upper torso and left shoulder 10 to achieve the correct orbital position If the edge line of the left hip 13 had moved to the golfer's right, the computer would recognize that the golfer had made a "reverse pivot", one of the most common errors for amateur golfers.

Figure 3E:
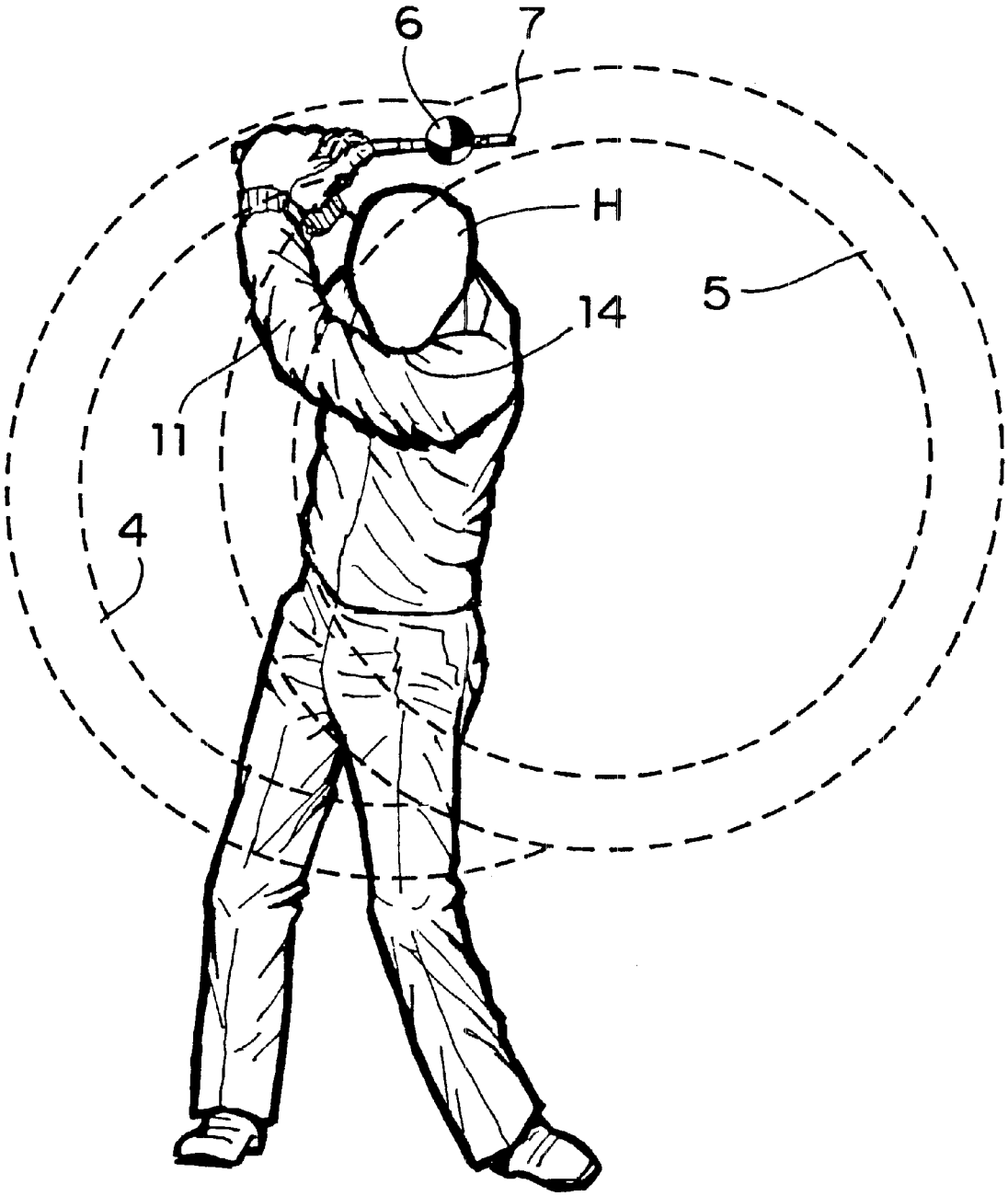

FIG. 3E shows the full completion of the back swing and the left shoulder turn. The sphere 6 has entered the forward swing orbit 5. The image of the sphere 6 shows that the clubface is correctly rotated toward the camera 3 and that the swing is on plane. The computer verifies that the golfer's head H is correctly pointed so that he or she can see the ball. Since the edge of the chin line 14 is visible, the golfer's head H is correctly raised to permit the proper left shoulder 10 turn.

Figure 3F:
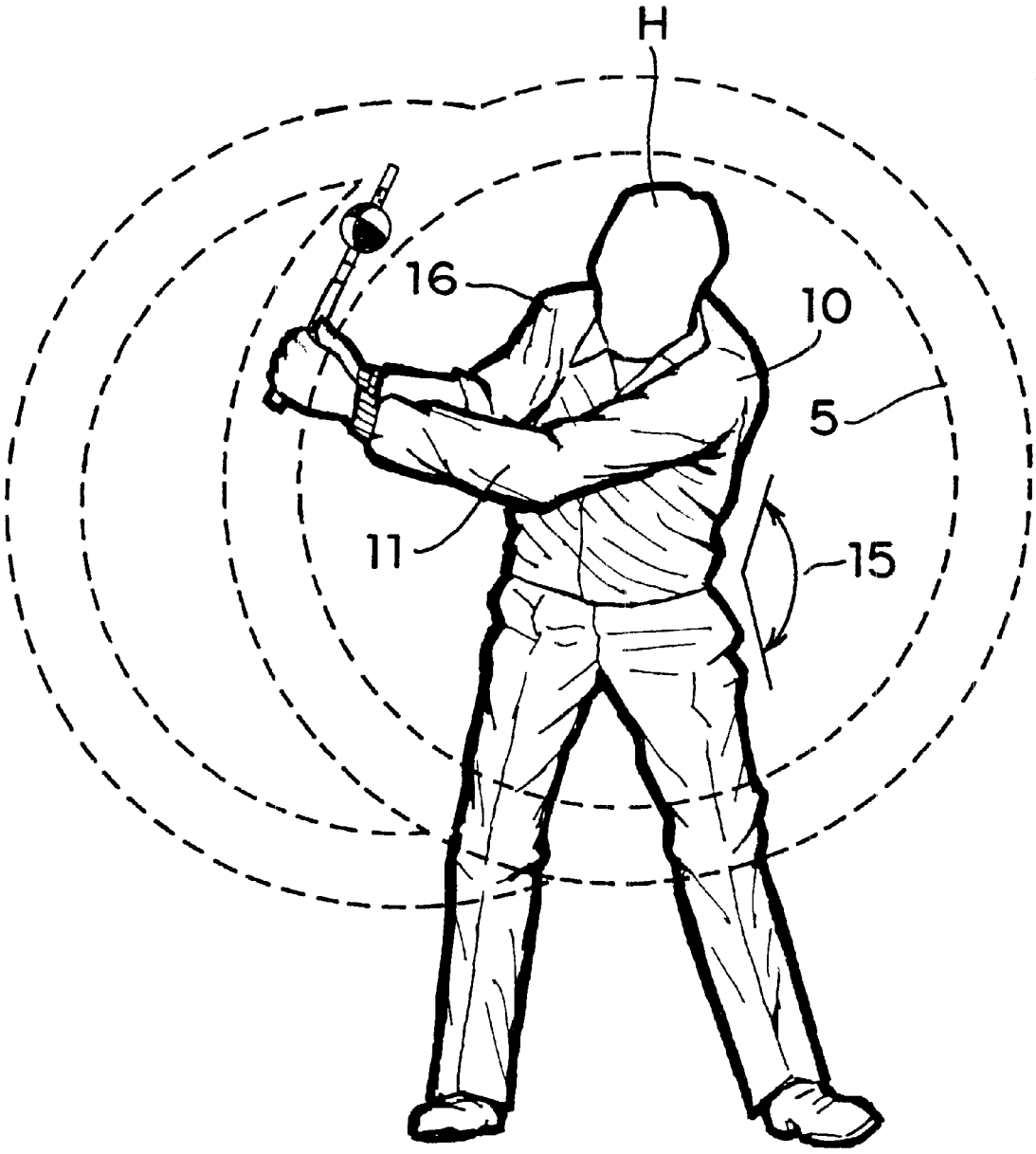

FIG. 3F shows a continuation of the forward swing. The initial phase of the forward swing is characterized by rapid and powerfull uncoiling of the left shoulder 10. At the same time the left arm 11 has lowered while the wrists 12 remain cocked with the club shaft 7 in a near vertical position. This movement of the left shoulder 10 has changed the center of the swing circle and consequently defined the circular forward swing orbit 5. The image of the sphere 6 verifies to the computer that the clubface is correctly rotated toward the camera 3; that the grip end of the club still points along the target line; and that the swing is on plane. The computer verifies that the edge lines of the golfer's left side and left leg produce an angle 15 that is less than 180 degrees. This indicates that significant hip turn has correctly occurred while the sphere is at this orbital location.

Figure 3G:
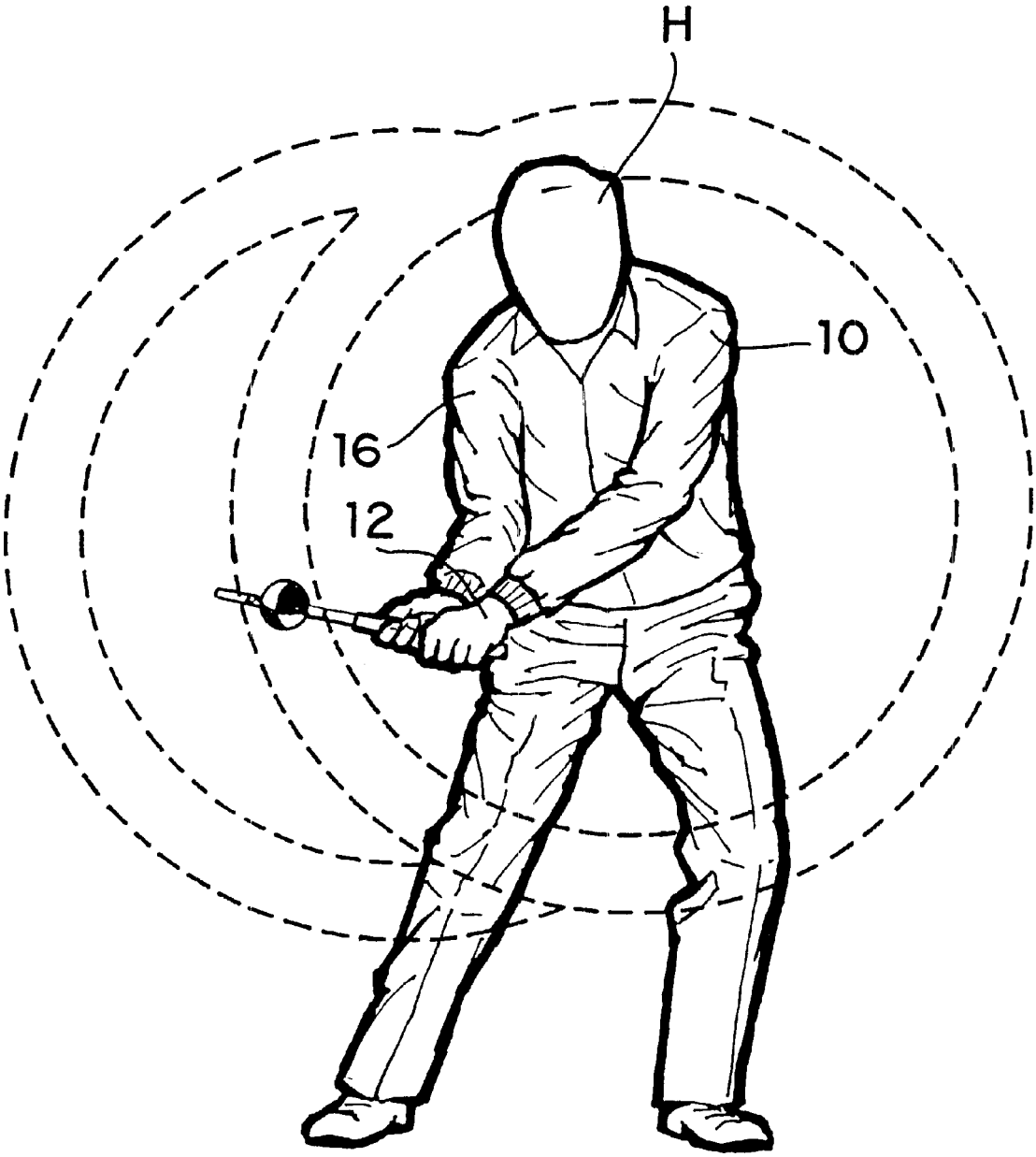

FIG. 3G shows that the left shoulder 10 has returned to the original stance position, but the lower body has accelerated its turn while the wrists 12 remain cocked as the right shoulder 16 begins to turn toward the target. The club shaft has not rotated very much during the forward swing as yet as indicated by the patterns of the sphere 6 that indicates the clubface is still facing the camera 3. The club shaft direction as determined by the image of the spherical attachment in FIG. 2 is toward the target and on plane.

Figure 3H:
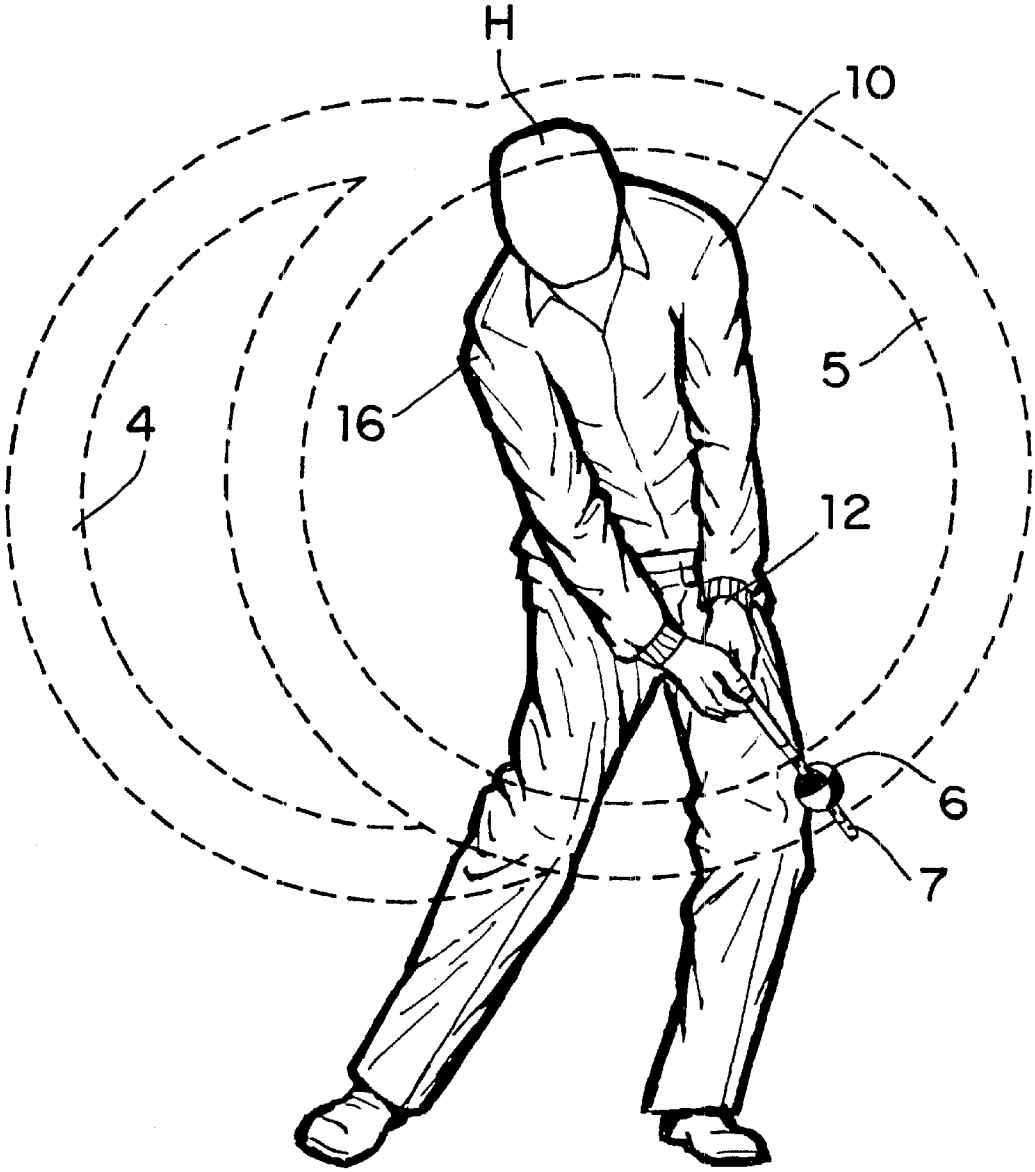

FIG. 3H shows the forward swing after impact as the wrists 12 are un-cocked while the entire body is turning toward the target. As the wrists 12 un-cock, they are also rotating the club shaft 7 so that the clubface is facing the target at impact as determined by the video camera's 3 image of the spherical attachment. The clubface direction shortly after impact is very important in predicting whether the swing achieved a "natural draw", "duck hook" or "slice". The sphere's 6 correct forward swing orbit 5 location and the golfer's head H positioned behind the golf ball indicate power was generated by the swing at impact. The computer's recognition by use of the patterns of the spherical attachment that the club shaft points to the golfer's right ear is very important at this orbital location.

Figure 3I:
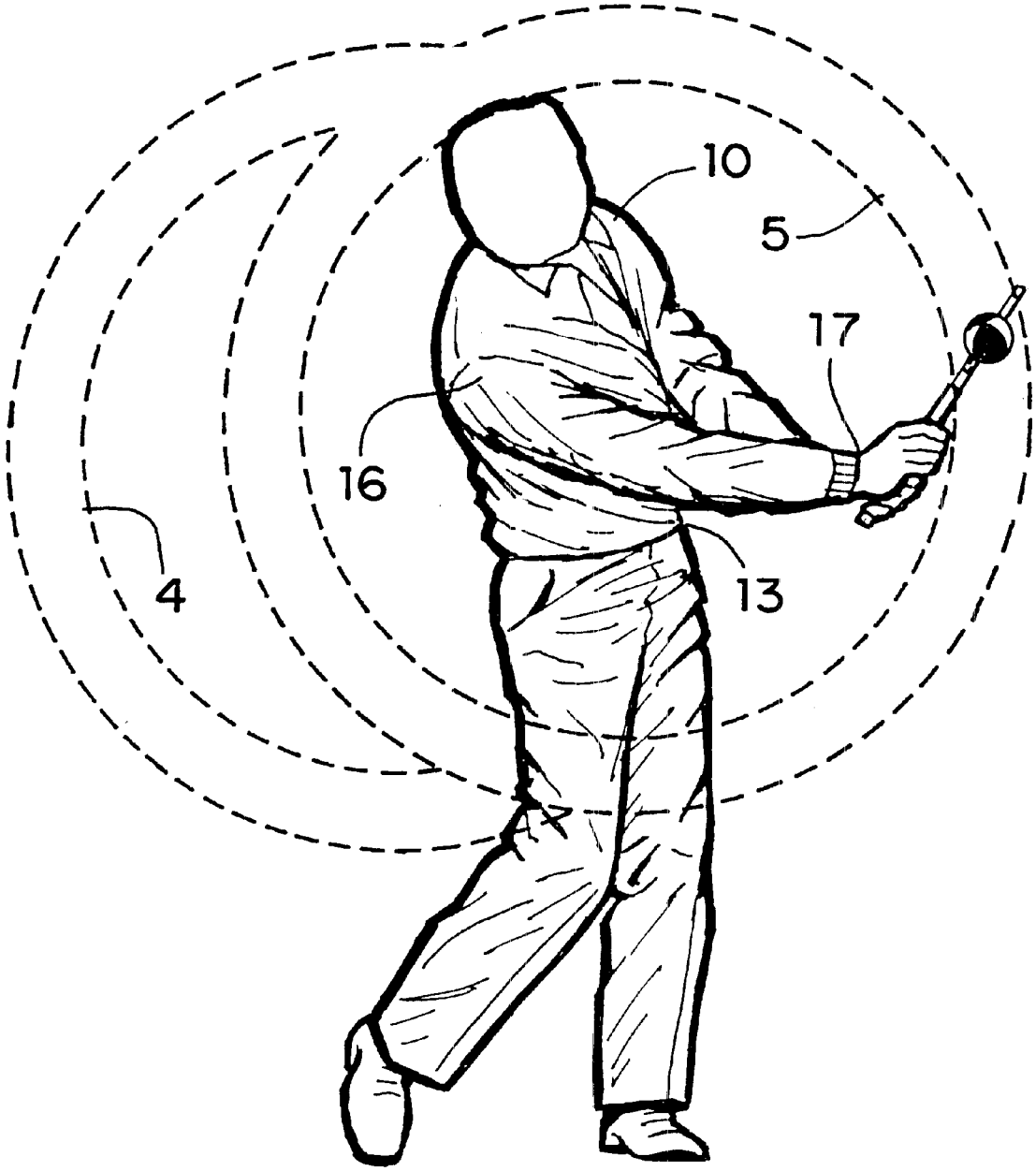

FIG. 3I completes the right shoulder turn toward the target as the wrists 12 cock once again to accept the momentum of the swing. Club shaft rotation 7 as determined by the image of the spherical attachment verifies to the computer that the clubface is correctly pointing away from the video camera 3. The sphere 6 continues to show that the swing is on plane. The computer recognizes that the golfer's head position while turned toward the target is essentially in the same location as it is in the golfer's normal stance position verifying that he or she was correctly behind the ball at impact. This position represents a correct "follow through".

Figure 3J:
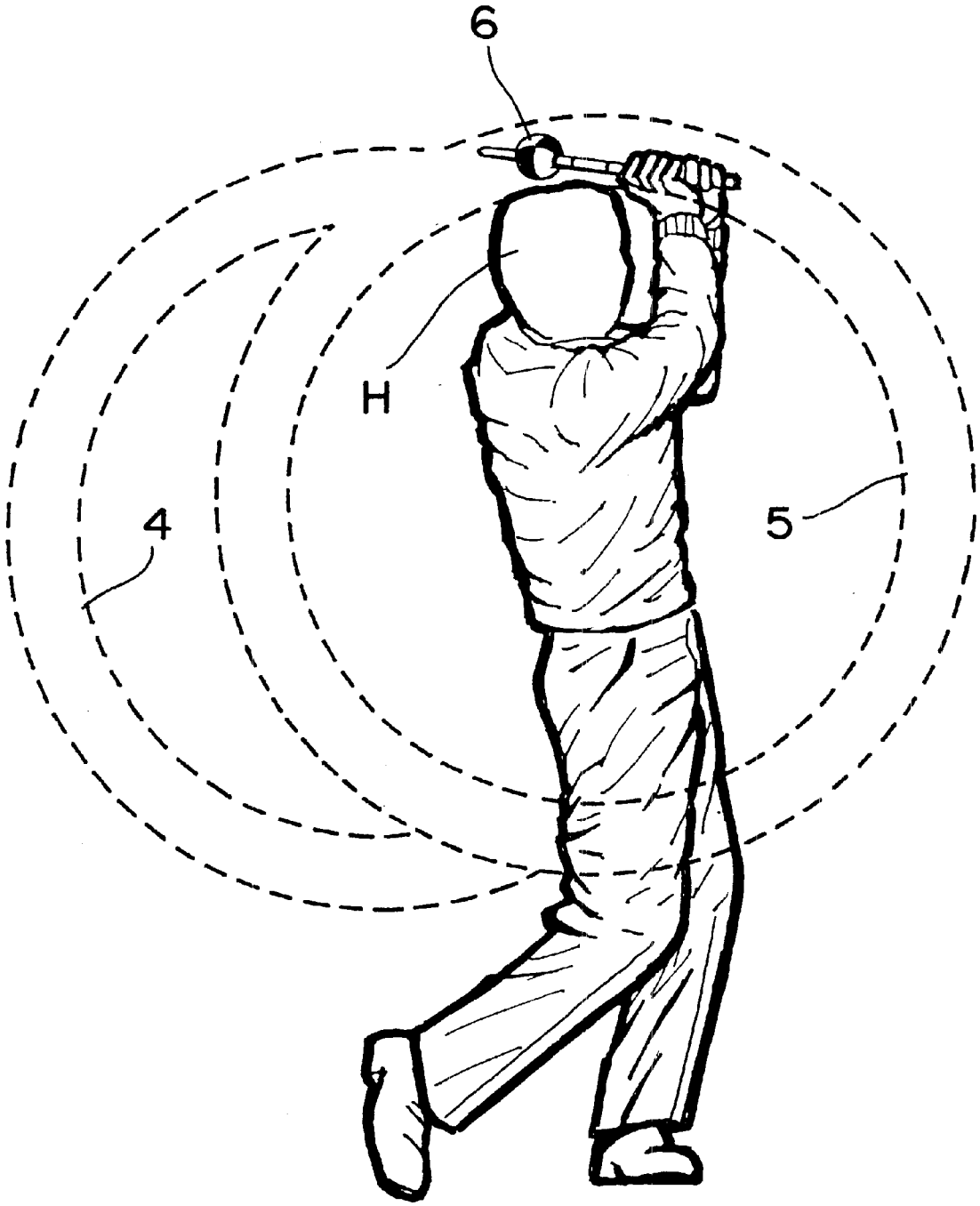

FIG. 3J completes the forward swing as the club speed decelerates and the entire body turns toward the target. The sphere 6 continues to show that the swing is on plane. The golfer's head position has moved forward significantly showing that he or she is on balance.

Figure 3K:
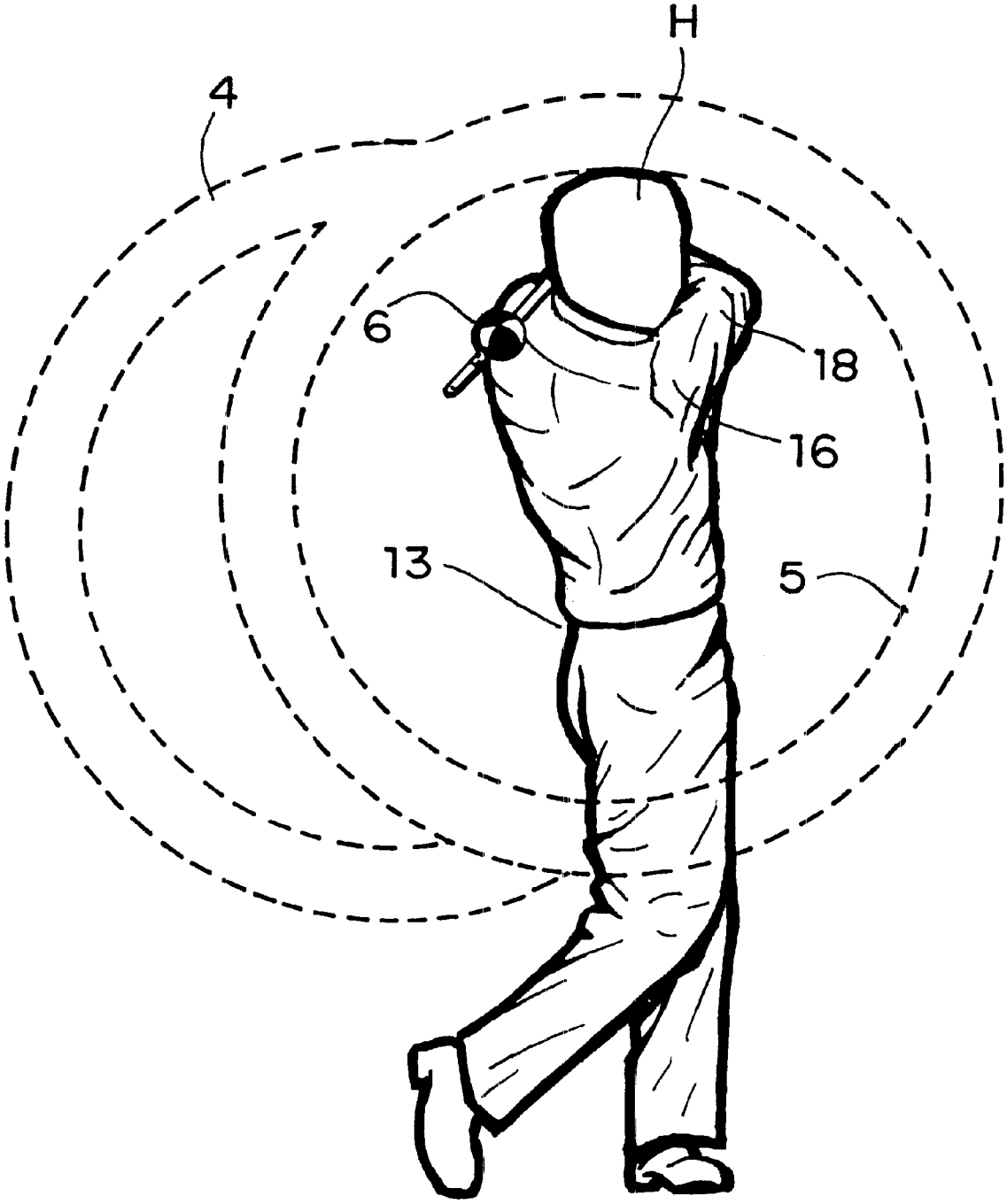

FIG. 3K shows the "world class finish" position. The golfer's weight has been transferred forward onto his or her left leg and the sphere 6 has dropped from its forward swing orbit 5 to rest on his or her left shoulder.

The above sequence of moves through FIGS. 3A to 3K represents an ideal swing for all golfers to attain. A student simply stands in front of the camera 3 and tries to emulate the displayed ideal swing. Any deviation from an ideal swing is recognized by the computer that immediately responds with visual and audible feedback or by written instructions displayed on the monitor. Illustrations are also used to notify or prompt the student of correct club and body positions. These immediate responses by the computer in response to images received from the video camera of the golfer's actual club and body movements are indicative of the "interactive" nature of the golf swing analyzer.

Activities of the present invention are selected by means of a conventional computer interface consisting of a mouse and keyboard. An activity category can be chosen including "swing freely", "analyze complete swing", "save last swing", "instant replay" or "calibrate orbits". The buttons to initiate or change an activity remain on the screen at all times.

After choosing an activity, several options may appear that are associated with that activity. Several display selections may be possible as well. After all selections are completed, the monitor displays a message asking the student to assume his or her normal stance in front of the camera.

Figure 4:
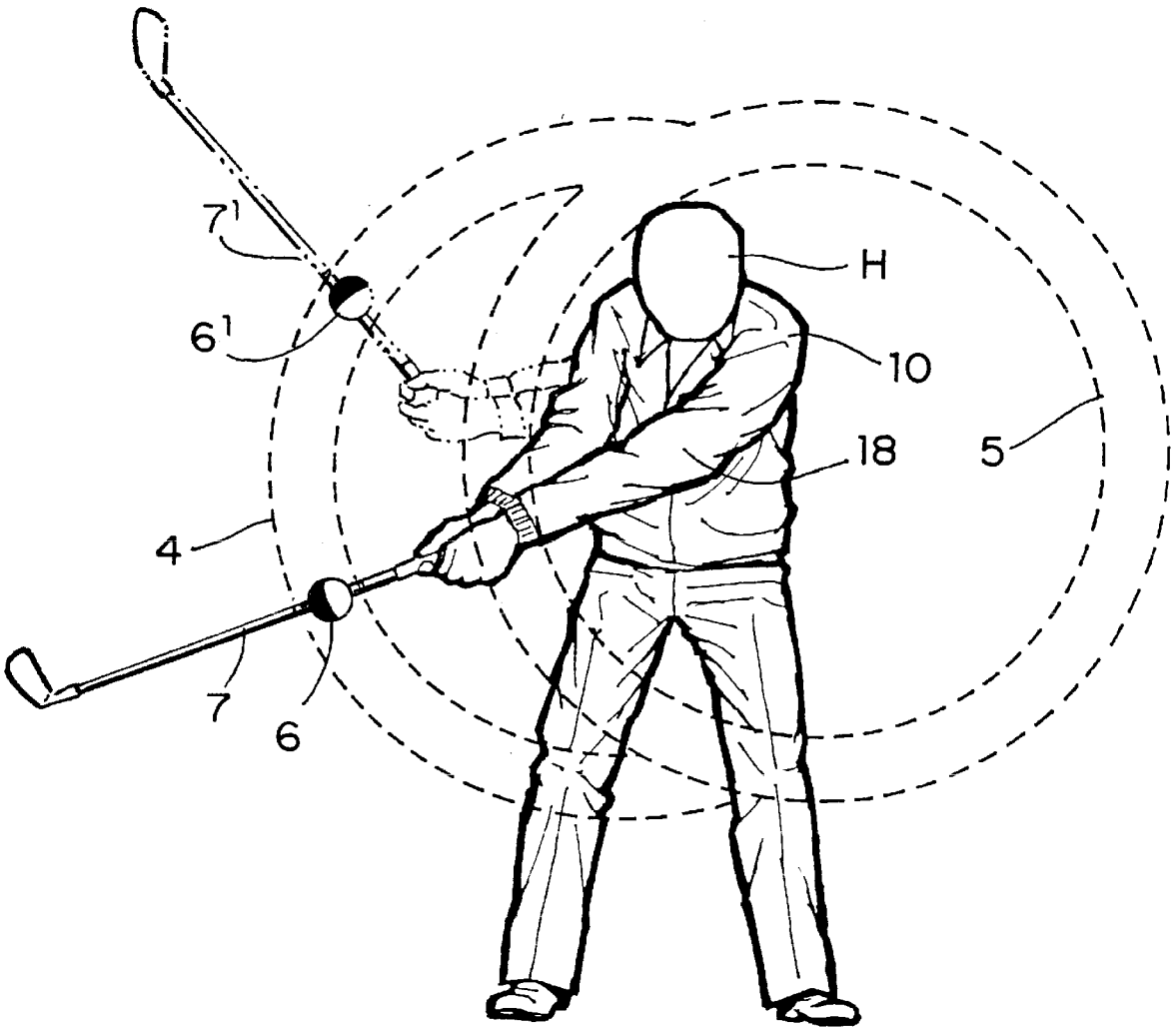
FIG. 4 shows the location of the golf club in an actual location and in a projected location.

FIG. 4 illustrates interactivity of the golfer with the computer and its display on the monitor. As the golfer moves his club, the computer is able to stay a number of frames ahead and to provide the correct club shaft 7' direction and club face rotation for the near future step of his or her swing even though the pace of the swing is determined solely by the golfer. Since the computer instantaneously recognizes the current progress of the golfer's swing by the image of the sphere 6, all prompts are interactive and enlightened. Thus in FIG. 4, the present location of the sphere 6 attached to the golf club is shown at about seven o'clock in the semicircular back swing orbit 4 and the displayed future position of the sphere 6' attached to the club is shown at the ten o'clock position of that orbit. An illustration similar to FIG. 3C can also be displayed as a prompt for the correct future body position that corresponds to the displayed correct future club position as recognized by the sphere 7'.

Figure 5:
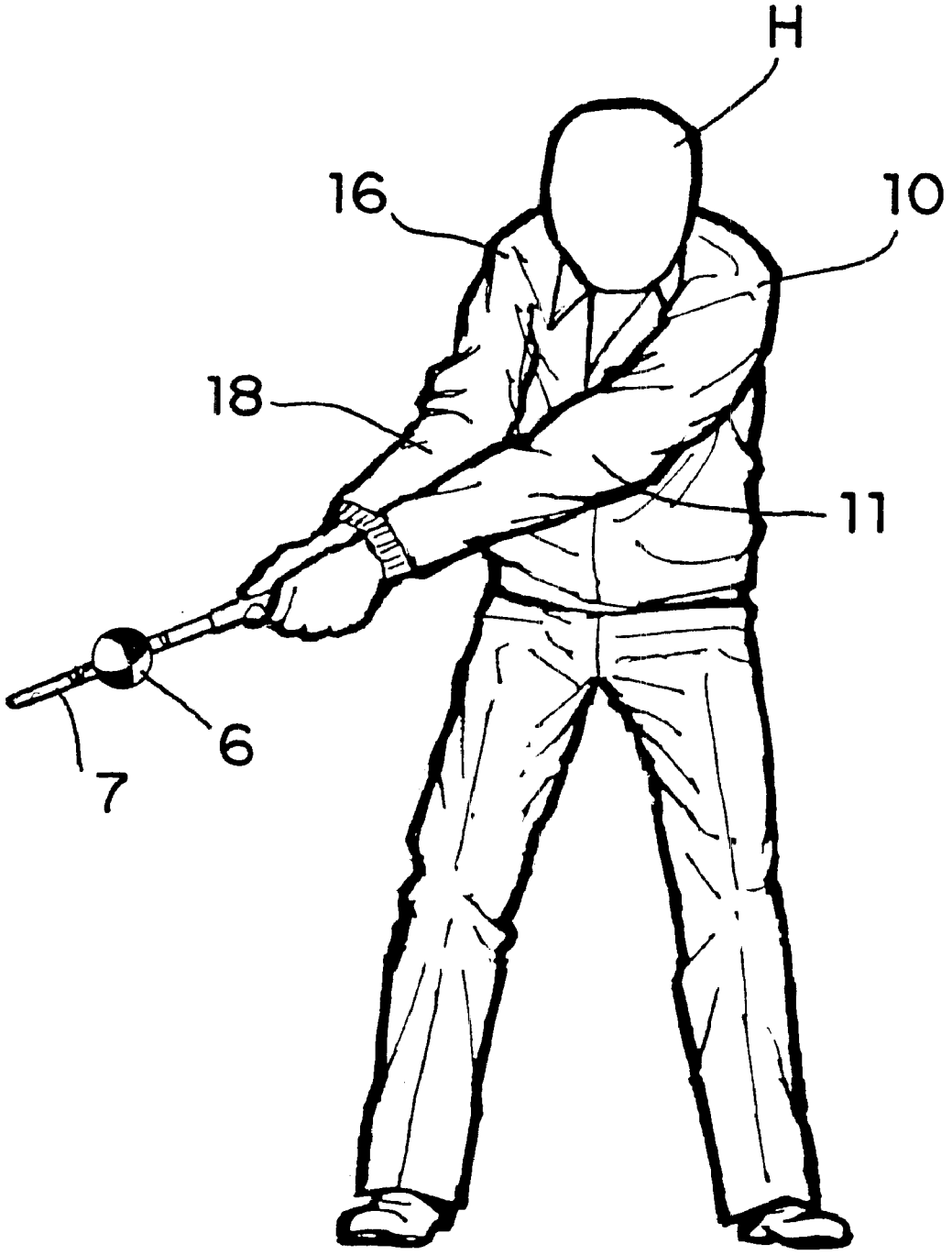
FIG.5 shows a method of calibrating the pattern of an ideal golf swing corresponding to the physical characteristics of a golfer.

FIG. 5 shows the first body adjustment that the student is asked to make to calibrate his or her orbits. The calibration process begins as the computer monitor continues to display messages until the images of the student confirm that he or she has assumed a proper stance at approximately the correct distance from the camera. Once the stance position is correct, a silhouette is drawn on the monitor of the student's stance position along with a highlighted outline of the spherical attachment. The student is asked to make several short calibration movements. He or she is first asked to hold the golf club parallel to the ground while pointing the grip end of the club at the target, shown in FIG. 5. His or her left knuckles should be directly above the right toes with the left arm fully extended and no bend of the left elbow. An animated figure at the bottom of the screen illustrates the correct positions. Once this position is achieved, he or she must hold the club still for two seconds. A message then appears to assume a similar position in the opposite direction, right knuckles over left foot, grip end pointing away from the target. The orbits are then calculated and displayed along with the stance position of the student. The above process allows the software to tailor the orbits to the golfer's height and arm reach based upon images that are interactively achieved and processed in real-time.

The initial orbits are determined by computing the distance of a line that connects the bottom of the spherical attachment of the club to the top of the golfer's head while in his normal stance. This line can be viewed as the base of two equal right triangles that have 12-degree angles emanating from the bottom of the sphere 6 as their hypotenuse. Each hypotenuse equally divides a circle and is equal to its diameter. The circle to the golfer's right forms the outer edge of the back swing orbit 4 for a right-handed golfer. The other circle forms the outer edge of the forward swing orbit 5. The calibration movements cause the dimensions of the orbits to be adjusted if the spherical attachment does not correctly align with the back swing orbit 4. The "swinging freely" activity is then selected by default.

When the activity is "swinging freely, the student can select from several options including "freeze frame on first error". He or she may choose to display the orbits with or without club shaft and club head position references. The student can swing the club freely back and forth at his or her own speed. As the student attempts to keep the sphere 6 within the orbits, he or she may observe the club shaft direction and clubface rotation guides at orbit locations that properly lead the golfer as shown in FIG. 5. Additionally, the software can freeze the frame on the computer monitor at any orbital location if a club movement error is made and the option is enabled. Various orbital checkpoint locations can be selected corresponding roughly to FIGS. 3B–3J.

If the activity is "analyze complete swing", then the student must take his or her normal stance and perform a complete swing. Once completed, the student can view a detailed analysis of his or her swing at each orbital checkpoint location in sequence by advancing the display with the "next" button. The first evaluation made by the computer software concerns the location of the sphere 6 within the orbits 4 and 5 for each orbital checkpoint. The club shaft direction and the clubface rotation are also checked. Failure of any of the club positions to match the requirements at that checkpoint generates a series of messages and suggestions. The recognition software finds body edges relative to orbit locations using Sobel approximation to determine maximum gradient to check major body part position for each checkpoint and reports irregularities with corrective graphic displays. Timing of the swing is evaluated before and after impact to predict ball flight distance. Club shaft rotation angles and body position as determined by the edge detector are used to predict and display simulated ball flight.

A handicap rating and explanation for the rating are also provided. This rating is based upon a correctness total that is computed at each checkpoint during the detailed analysis. Scoring is based upon correct club position and body position throughout the swing, but with emphasis at key points such as the impact position. The software program estimates a USGA handicap rating for a swing based upon the correctness totals that a golfer with that handicap rating normally achieves.

Instant replay of the swing last analyzed can be done at regular speed or in slow motion. It can also be performed step-by-step through the orbital checkpoints and with or without detailed analysis.

Figure 6:
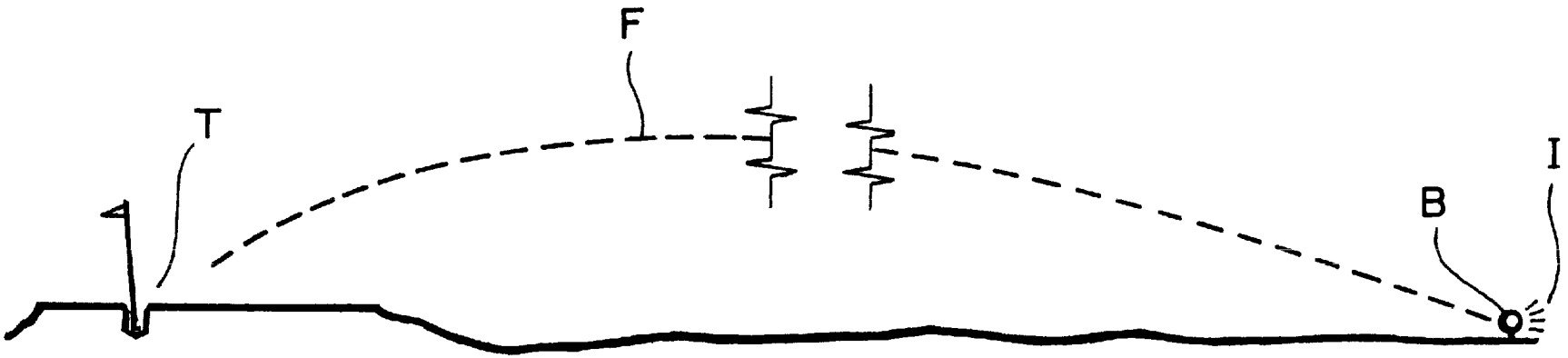
FIG. 6 shows the predicted flight of a golf ball toward the target after impact.

FIG. 6 illustrates the predicted flight of the ball B toward the target T after the club has passed the impact position I during a swing. The monitor displays the direction, curvature and distance of the predicted flight of the ball B. This prediction is based upon the patterns and timing of the images of the sphere 6 before and after the club passes the impact position and the images of the golfer's body position during impact. This display further reassures the golfer of his or her progress toward achieving the ideal swing.

What is claimed is:

1. An interactive method of tracking and analyzing a golf swing with a computer including the steps of placing a golfer in front of a video camera associated with said computer, superimposing a pattern of an ideal golf swing on a display monitor of said computer over the live background image of said golfer, said display monitor being clearly visible to said golfer, inducing said golfer to attempt to emulate said pattern of an ideal golf swing as shown on said display monitor, said computer comparing each of a plurality of sequential images captured by said video camera of said golfer's swing to pattern of an ideal golf swing and responding to the correctness of said golfer's swing in real time, including the step of placing an attachment on a club shaft of said golfer, said attachment exhibiting a surface having a color pattern thereon that is captured by said video camera and is readily recognizable by said computer, said attachment being instrumental for tracking and analyzing the correctness of said attempt to emulate said pattern of an ideal golf swing.

2. The method of claim 1, including said computer's ability to provide audio and visual responses to the correctness of said golfer's swing in real time according to the progress of said golfer's partial swing said progress being determined solely by said golfer.

3. The method of claim 1, including said computer's ability to update said pattern of an ideal golf swing on said display monitor in real time according to the progress of said golfer's partial swing said progress being determined solely by said golfer.

4. The method of claim 1, wherein said pattern of an ideal golf swing includes a display of an approximately semicircular orbit for a back swing and an approximately circular orbit for a forward swing.

5. The method of claim 4, wherein said pattern of an ideal golf swing includes a display of the correct three dimensional club shaft direction, the correct club shaft rotation angle and the golfer's correct body position corresponding to a plurality of locations within said swing orbits.

6. The method of claim 1, wherein said tracking and analyzing a golf swing include the ability for said computer to independently determine said golfer's club position at any time during said golfer's swing from images captured by said video camera.

7. The method of claim 1, wherein said tracking and analyzing a golf swing include the ability for said computer to independently determine said golfer's body position at any time during said golfer's swing from images captured by said video camera.

8. The method of claim 1, wherein said attachment is a sphere having four equal sized quadraspheres thereon that are alternating in colors.

9. The method of claim 8, including placing polar direction indicators on said shaft above and below said attachment, one of said polar direction indicators having color patterns that uniquely correlate to a specific rotation angle, such as a barber pole effect.

10. The method of claim 1, including the steps of tracking and analyzing said golfer's swings while said golfer swings freely back and forth.

11. The method of claim 1, including the step of said computer automatically calibrating said pattern of an ideal golf swing individually for said golfer based upon said golfer's size and said golfer's physical characteristics from images captured by said video camera.

12. The method of claim 1, wherein said method of placing a golfer in front of a video camera includes placing said golfer in different body views, including said golfer's front, left or right sides.

13. The method of claim 1, including the step of said computer predicting the ball flight and displaying said predicted ball flight toward a target on said display monitor after said golfer's club passes through the impact position.

14. The method of claim 1, including the step of said computer displaying a handicap rating on said monitor for said golfer representing said golfer's skill level following said attempt to emulate said pattern of an ideal swing.

15. The method of claim 1, including the step of choosing various activities by interfacing with said computer, wherein said activities are chosen from the group consisting of swing freely, analyze complete swing, save last swing, instant replay, calibrate orbits and freeze the display on error.

16. A method of teaching a golfer a correct golf club swing by said golfer interacting with a computer including the steps of said golfer standing in front of a video camera associated with said computer, said computer superimposing a pattern of an ideal golf swing on a display monitor of said computer over the live background images of said golfer, said display monitor being clearly visible to said golfer, said golfer attempting to emulate said pattern as shown on said display monitor, said computer thereafter comparing each of a plurality of sequential images captured by said video camera of said golfer's swing to said pattern of an ideal golf swing in order that said computer is able to respond as to the correctness of said golfer's swing in real time according to the progress of said golfer's swing, said progress being determined by said golfer, including the step of placing an attachment on a club shaft of said golfer, said attachment exhibiting a surface having a color pattern thereon that is captured by said video camera and is readily recognizable by said computer, said attachment being instrumental for tracking and analyzing the correctness of said attempt to emulate said pattern of an ideal golf swing.

17. An apparatus for interactive tracking and analyzing a golf swing comprising a computer having a display monitor therewith and a video camera for receiving images that are then relayed to the computer, first means for displaying a pattern of an ideal golf swing on said monitor, second means for displaying, by superimposing on said monitor a golfer's swing attempt to emulate said pattern of an ideal golf swing, means for comparing said first display to said superimposed second display pattern including means attached to a golf club of said golfer for displaying a color pattern recognizable by said computer.

18. The apparatus of claim 17 wherein said means attached to said golf club is in the shape of sphere.

19. The apparatus of claim 18, wherein said sphere is of light weight construction and the surface of said sphere is divided into four quadraspheres.

20. The apparatus of claim 19 including a polar direction indicator attached to said golf club, said polar direction indicator having color patterns that uniquely correlate to a specific rotation angle, such as a barber pole effect.

* * * * *